US005785427A

United States Patent [19]

Godshaw

[11] Patent Number: 5,785,427

[45] Date of Patent: Jul. 28, 1998

[54] CONVERTIBLE SEAT AND TOTE BAG

[75] Inventor: Donald Godshaw, Evanston, Ill.

[73] Assignee: High Sierra Sport Company, Vernon Hills, Ill.

[21] Appl. No.: 623,189

[22] Filed: Mar. 28, 1996

[51] Int. Cl.[6] ..... B65D 33/06

[52] U.S. Cl. ..... 383/4; 5/652; 5/656; 190/8; 297/118; 297/183.5

[58] Field of Search ..... 297/183.8, 183.3, 297/183.5, 183.6, 183.7, 129, 151, 118, 350, 351, 452.57; 5/652, 656, 657; 190/8; 383/4, 13

[56] References Cited

U.S. PATENT DOCUMENTS

| | | | |
|---|---|---|---|
| D. 79,587 | 10/1929 | Forst . | |
| D. 121,266 | 7/1940 | Archer . | |
| D. 212,880 | 12/1968 | Victorero | D15/8 |
| D. 225,817 | 1/1973 | Torrey | D6/200 |
| D. 254,582 | 4/1980 | deSantis | D6/66 |
| D. 274,108 | 6/1984 | Trotman et al. | D6/201 |
| D. 329,148 | 9/1992 | Hwang et al. | D6/368 |
| D. 359,411 | 6/1995 | Wade | D6/610 |
| 1,140,997 | 5/1915 | Minehart . | |
| 1,802,853 | 4/1931 | Weltner . | |
| 2,001,252 | 5/1935 | Johnson | 155/133 |
| 2,044,717 | 6/1936 | McElmoyl | 190/8 |
| 2,457,978 | 1/1949 | Curran | 155/153 |
| 2,570,571 | 10/1951 | Leeman | 190/8 |
| 2,792,875 | 5/1957 | Pirrone | 155/133 |
| 3,120,406 | 2/1964 | Shelton | 297/453 |
| 3,143,748 | 8/1964 | Manning | 5/344 |
| 3,825,298 | 7/1974 | Chipman | 297/129 |
| 4,003,455 | 1/1977 | Cortese | 190/8 |
| 4,190,918 | 3/1980 | Harvell | 5/465 |
| 4,518,203 | 5/1985 | White | 297/118 |
| 4,597,605 | 7/1986 | Gilbert | 297/183.5 |
| 4,687,248 | 8/1987 | Ross et al. | 297/129 |
| 4,736,825 | 4/1988 | Belfi | 190/8 |
| 4,768,834 | 9/1988 | Walsh | 297/466 |
| 4,810,102 | 3/1989 | Norton | 383/13 |
| 4,824,171 | 4/1989 | Hollingsworth | 297/351 |
| 4,925,241 | 5/1990 | Geraci | 297/229 |
| 4,942,948 | 7/1990 | Vickers | 190/8 |
| 5,120,108 | 6/1992 | Watson et al. | 297/188 |
| 5,240,330 | 8/1993 | Thompson | 383/4 |
| 5,384,923 | 1/1995 | Hwang et al. | 5/656 |
| 5,560,056 | 10/1996 | Tai | 297/118 |
| 5,584,422 | 12/1996 | Bond-Madsen | 383/4 |

OTHER PUBLICATIONS

"The Original Crazy Creek Chair" product brochure (date unknown).

*Primary Examiner*—Stephen P. Garbe
*Attorney, Agent, or Firm*—Rudnick & Wolfe

[57] ABSTRACT

A convertible seat and tote bag apparatus includes a first panel foldable relative to a second panel. A support member is adapted to interconnect the first panel and second panel so that when a person sits on one of the panels, the support member restrains rearward movement of the other panel as the person leans against the other panel. In one aspect of the invention, a pair of connectors extend from opposite side edges of the first panel and are adapted to be removably attached to corresponding side edges of the second panel to define a tote bag. In another aspect of the invention, a connector is attached to one of the first and second panels and is adapted to releasably engage the support member to define a handle when the apparatus is configured as a tote bag.

30 Claims, 4 Drawing Sheets

4/4

58
14
52
52
10
45
40
48
45
20
20
15
30
30
44
44
47
42
40
18
18
11
47
46
46
50
50
17
38
36
58
42
12
36
17
40
38

58
10
17
38
14
15
40
42
13
17
38
40
12

CONVERTIBLE SEAT AND TOTE BAG

FIELD OF THE INVENTION

The present invention relates generally to foldable portable chairs, and more particularly, to a beach chair which is convertible to a tote bag.

BACKGROUND OF THE INVENTION

There are numerous types of foldable portable chairs in the marketplace for use at a beach or other outdoor locations such as campgrounds. Typically, these types of chairs are made of lightweight material such as plastic or canvas to facilitate transportation. However, the material is often supported by metal bars or rods to provide the necessary support for a user sitting in the chair. In addition, many of these chairs include metal bars acting as legs so that a person sitting on the seat is raised above the ground. These metal bars tend to make transportation of the chair more difficult because of the unbalanced weight of the chair and the tendency for the chair to open as it is being carried by the user. In addition, many such chairs include mechanical adjustment mechanisms such as ratchet mechanisms which can be cumbersome to operate and tend to break over time. Moreover, such mechanical adjustment mechanisms add to the weight of the chair, making it more difficult to carry.

There are also various types of carrying or tote bags in the marketplace for transporting articles to a desired location where it is also necessary to bring a foldable chair. For example, various items such as towels, lotion, clothing, food and drinks are often brought to the beach along with a lounge chair. Typically, such tote bags include handles and are made of a flexible, lightweight material to make it easier to carry these items. Although these types of chairs and tote bags are lightweight, it may nonetheless be difficult to carry a full tote bag as well as a chair.

Various attempts have been made to provide a foldable portable chair which is convertible into a tote bag. Some of these devices continue to utilize metal support bars and legs, which can be cumbersome and heavy as mentioned above. Other devices utilize connecting flaps which are permanently attached to the back and seat panels of the chair, which tends to be unsightly when the device is folded to the bag position wherein the flaps are crumpled together. It therefore remains desirable to provide an attractive, lightweight foldable chair which can be converted into a tote bag.

SUMMARY OF THE INVENTION

In view of the above, and in accordance with one aspect of the present invention, there is provided a convertible seat and tote bag apparatus including a first panel foldable relative to a second panel. A support member is adapted to interconnect the first panel and second panel so that when a person is sitting on one of the panels, the support member restrains rearward movement of the other panel as the person leans against the other panel. In one aspect of the invention, a pair of side flaps extend from opposite side edges of the first panel and are adapted to be removably attached to corresponding side edges of the second panel to allow the seat to be readily converted to a tote bag, and vice versa. In another aspect of the invention, a connector is attached to one of the first and second panels and is adapted to releasably engage the support member to define a handle when the apparatus is configured as a tote bag.

In a preferred embodiment of the present invention, the first and second panels are configured as a seat panel and a back panel made of a generally flexible, lightweight material. The side flaps preferably extend from the seat panel and are configured with a transparent mesh pattern of flexible material. In addition, fasteners are provided on the edges of the side flaps and the side edges of the back panel to allow quick attachment of the side flaps to the back panel. A relatively narrow bottom panel is also provided to define a hinge between the seat and back panels. Thus, when the seat is converted to a tote bag, the bottom panel, which can be relatively rigid, allows the tote bag to stand upright. The bottom panel may also increase the carrying capacity of the tote bag.

Preferably, a pair of lateral flaps extend from opposing side edges of the bottom panel and flip inwardly when the side panels are closed to fill a space between each side flap and the bottom panel to inhibit smaller items from inadvertently falling from the bag. To provide structure for the back panel when the apparatus is configured as a seat, the back panel preferably includes elongated stiffener members extending along the side edges thereof. In addition, the support member includes a pair of detachable straps. When the apparatus of the preferred invention is configured as a seat, the straps extend diagonally between the first or back panel and the second or seat panel. In a most preferred embodiment, a pair of releasable fasteners are attached to the top corners of the back panel, and a pair of releasable fasteners are attached to the forward corners of the seat panel to promote quick attachment of the straps to the respective panels. Thus, the straps are adapted to releasably interconnect the respective top and forward clip members such that the back panel is generally perpendicular to the seat panel to define a seat.

To convert the configuration of the apparatus from a seat to a tote bag, the straps are preferably detached from the fasteners and the panels are moved into generally parallel relation relative to each other. The side flaps are then attached between the panels, thereby maintaining the panels in generally upright relation relative to each other. In a most preferred embodiment of the invention, a pair of fasteners are attached to an exterior surface of each panel. Thus, a pair handles can be formed when one of the straps releasably interconnects the fasteners on one panel, and the other strap releasably interconnects the fasteners on the other panel.

The present invention, together with further objects and advantages, will be best understood by reference to the following detailed description taken in conjunction with the accompanying drawings.

DETAILED DESCRIPTION OF THE PREFERRED EMBODIMENT(S)

Figure 1:
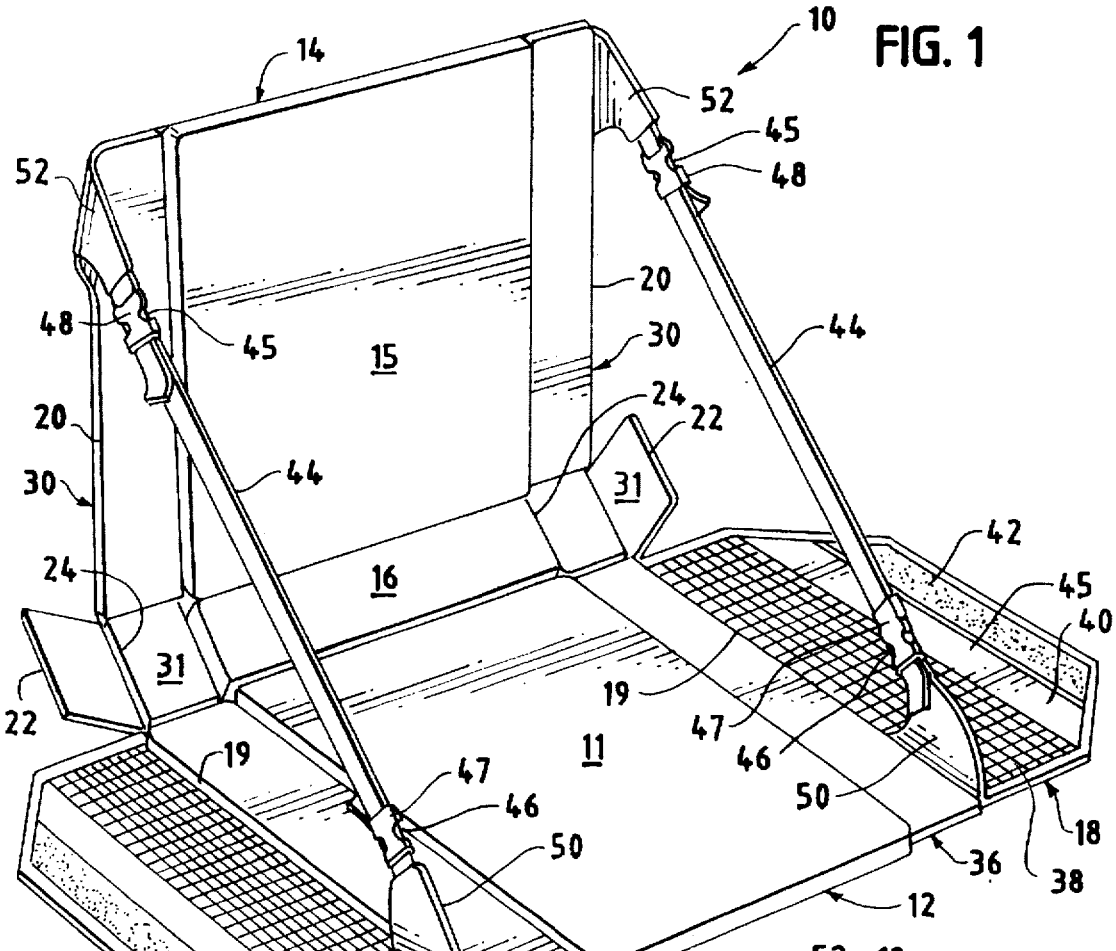
FIG. 1 is a perspective view of a preferred embodiment of the present invention showing an a convertible seat/tote bag apparatus assembled as a seat.

While the present invention is susceptible of embodiment in various forms, there is shown in the drawings and will hereinafter be described preferred embodiments of the invention with the understanding that the present disclosures are to be considered as setting forth exemplifications of the invention which are not intended to limit the invention to the specific embodiment illustrated.

Figure 2:
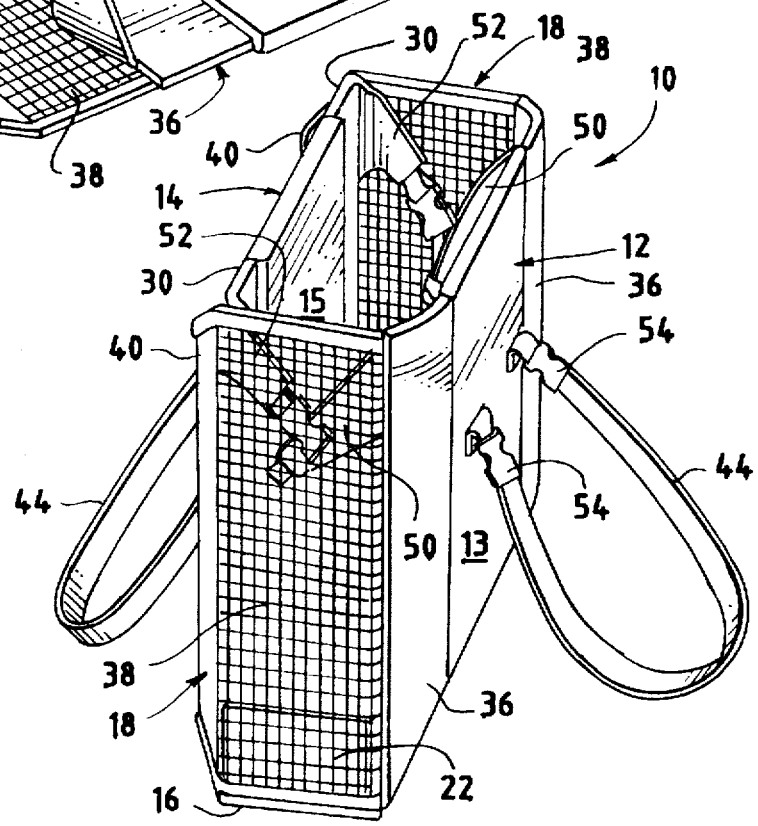
FIG. 2 is a perspective view of the present invention showing the apparatus assembled as a tote bag.

Referring now to the drawings, wherein like reference numerals refer to like parts throughout the several views, there is shown in FIG. 1 a convertible seat/tote bag apparatus 10 configured as a seat. The apparatus 10 includes a seat panel 12 hingedly secured to a back panel 14 by a relatively narrow bottom or intermediate panel 16. The seat panel 12 has inner and outer surfaces 11, 13, and the back panel 14 has inner and outer surfaces 15, 17. A pair of side flaps 18 extend from opposite side edges 19 of the seat panel 12 and are adapted to be removably attached to corresponding side edge portions 20 of the back panel 14 to define a tote bag as shown in FIG. 2. Preferably, a pair of relatively small lateral flaps 22 also extend from opposing side edges 24 of the bottom panel 16. As shown in FIG. 2, the lateral flaps 22 are adapted to flip generally inwardly when the side flaps 18 are closed to configure the apparatus as a tote bag. This fills a space between each side flap 18 and the bottom panel 16 to inhibit smaller items from inadvertently falling from the bag.

Figure 3:
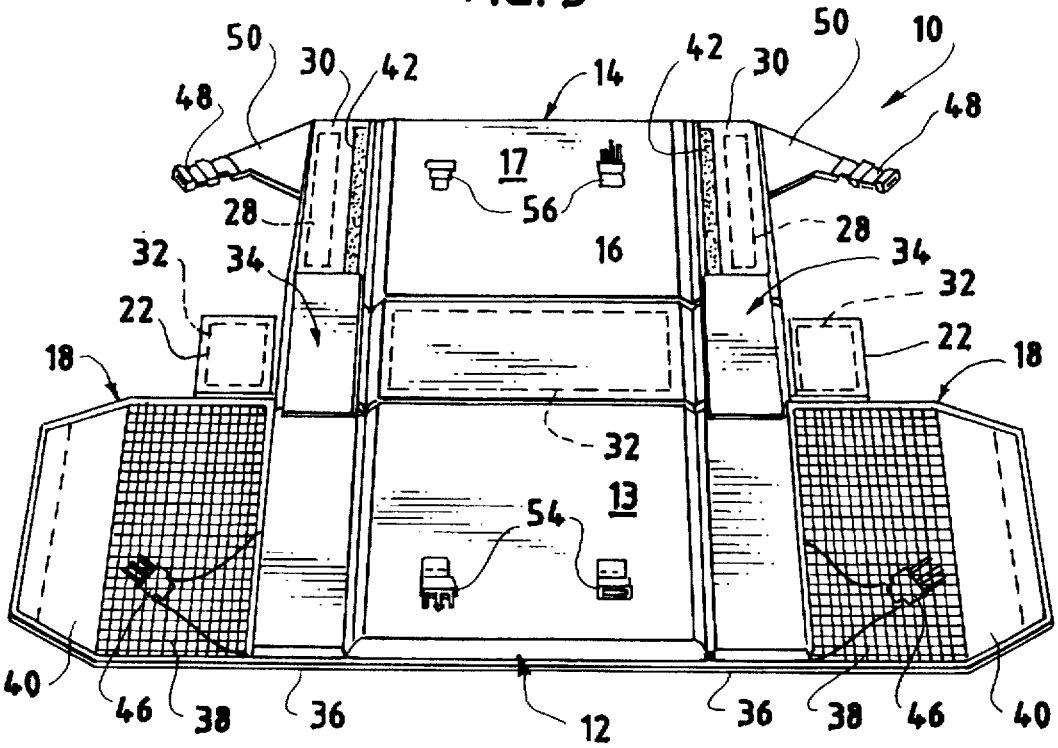
FIG. 3 is a perspective view of an exterior of the apparatus shown in an unfolded and disassembled position.
Figure 4:
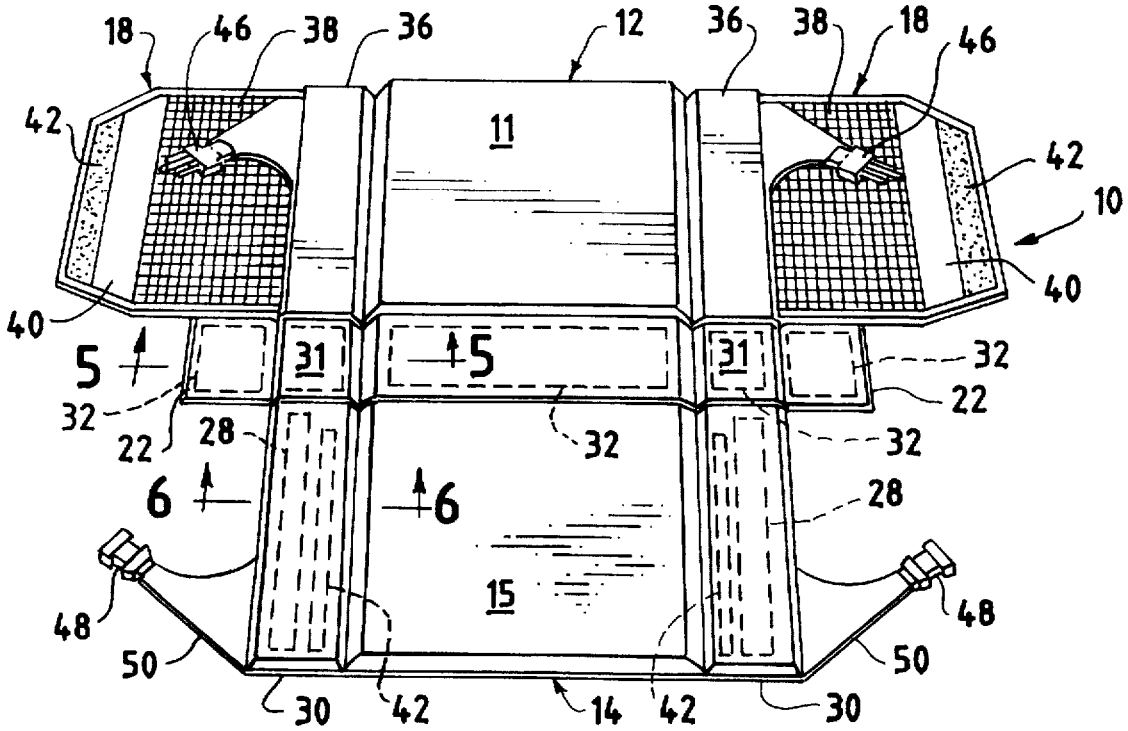
FIG. 4 is a perspective view of an interior of the apparatus shown in an unfolded and disassembled position.
Figure 5:
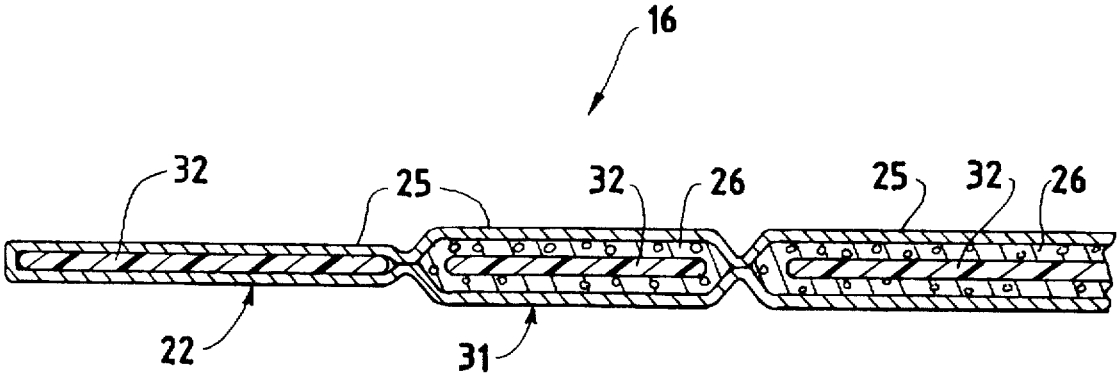
FIG. 5 is a partial cross-sectional view of the apparatus taken along the line 5—5 in FIG. 4.
Figure 6:
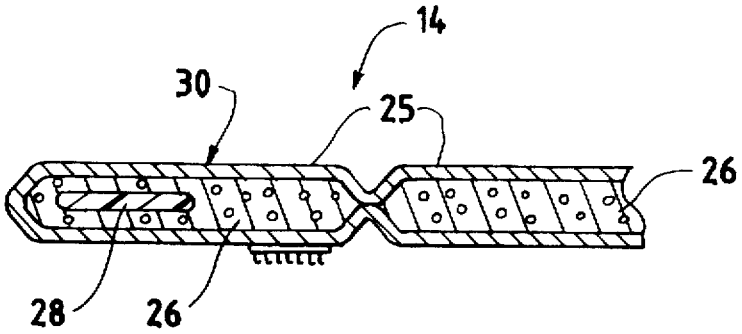
FIG. 6 is a partial cross-sectional view of the apparatus taken along the line 6—6 in FIG. 4.

In a most preferred form of the invention, the seat panel 12, back panel 14, bottom panel 16 and lateral flaps 22 are two-ply sheets 24 made of a flexible, durable, two-ply material such as nylon. As shown in FIGS. 5 and 6, the back panel 14 and bottom panel 16 are provided with foam padding 26. The seat panel 12 is also provided with foam padding for increasing the comfort of a user sitting in the seat 10. In addition, stiff internal resistant members 28 extend longitudinally within lateral sections 30 of the back panel 14 to provide structural support when the apparatus 10 is arranged in the seating configuration as illustrated in FIG. 1. Thus, the resistant members 28 allow the back panel 14 to stand upright in generally perpendicular relation relative to the seat panel 12. This obviates the need for a user to continually lift up the flexible back panel 14 which would otherwise sag without structural support. Similarly, and as shown in FIG. 3, the lateral flaps 22 and the bottom panel 16, including lateral sections 31 of the bottom panel 16, are provided with stiff internal boards 32 which may allow the tote bag 10 to stand upright as illustrated in FIG. 2. Preferably, the resistant members 28 and boards 32 are made of a semi-rigid plastic material such as polyethylene.

As will be appreciated, the panels 12, 14, 16 and flap 22 can be bound together by any suitable means such as stitching. As shown in FIG. 3, a pair of spaced apart, wear-resistant strips 34, preferably made of rubber, are secured longitudinally to an exterior surface portion of the panels 12, 14 and 16 to further secure the panels together and also to protect against abrasion due to placement of the apparatus 10 on the ground. Preferably, the strips 34 extend across an exterior surface portion of the bottom panel lateral sections 31 and longitudinally along an exterior surface portion of the back panel lateral sections 30 and seat panel lateral sections 36.

In the illustrated embodiment, the side flaps 18 include an inner longitudinal section 38 defining a mesh pattern of flexible plastic strands, and an outer longitudinal section 40 of flexible material such as nylon. Preferably, interior surfaces of the side flap longitudinal sections 40 and exterior surfaces of the back panel lateral sections 30 are configured with fasteners 42 for releasable attachment of the side flaps 18 to the back panel 14. In a most preferred embodiment of the invention, the fasteners 42 comprise hook and loop type fasteners, commonly referred to as VELCRO® strips, attached to the sections 30 and 40 of the back panel 14 and side flaps 18. In addition, stiff internal resistant members (not shown) may be provided within the outer sections 40 of the side flaps 18 to facilitate secure engagement of the fasteners 42.

When the apparatus 10 is configured as a seat as shown FIG. 1, a pair of detachable straps 44 extend diagonally between the seat panel 12 and back panel 14 to restrain rearward movement of the back panel 14 when a person sits on the seat panel 12 and leans against the back panel 12. Preferably, each strap 44 is adjustable in length and includes releasable fasteners at opposite ends thereof.

In the illustrated embodiment, the releasable fasteners include a conventional male clip 45 and a conventional female clip 47 that snap into assembled relation relative to each other and are easily and readily disconnected from each other through manual manipulation. To releasably secure the straps 44, a pair of seat clip members 46 are attached to respective corner portions of the seat panel 12, and a pair of back clip members 48 are attached to corner portions of the back panel 14. Preferably, the seat clip members 46 are female members and the back clip members 48 are male members. As shown, the straps 44 extend diagonally from the respective corner portions of the back panel 14 to the corresponding corner portions of the seat panel 12, and the seat panel 12 is generally perpendicular to the back panel 14 to define a seat. In a most preferred embodiment, the clip members 46, 48 are attached to ears 50, 52 which extend from the corner portions of the seat panel 12 and back panel 14. As a result, the ears 50, 52 can bend to accommodate the tension of the straps 44, thereby minimizing the tendency for the entire lateral sections 30, 40 of the back panel 12 and seat panel 14 to bend and possibly constrict a user sitting in the apparatus 10.

To convert the apparatus from a seat configuration as shown in FIG. 1 to a tote bag as shown in FIG. 2, the straps 44 are detached from the clips 46, 48, the seat panel 12 and back panel 14 are folded toward each other, the lateral flaps 22 are flipped inwardly, and the side flaps 18 are folded over to releasably engage the fasteners 42, thereby creating an enclosure defining a tote bag. As will be appreciated, the interior and exterior of the seat panel 12 and back panel 14 can be configured with various size pockets or compartments to accommodate and separate articles to be placed in the bag.

Another feature of the present invention is to allow the straps 44 to alternatively be used as handles to facilitate carrying the bag. Preferably, a first pair of handle clips 50 are attached to the outer surface 13 of the seat panel 12 and a second pair of handle clips 52 are attached to the outer surface 17 of the back panel 14.

When the apparatus 10 is to be configured as a tote bag, one of the straps 44 interconnects the handle clips 50, and the other strap 44 interconnects the handle clips 52, thereby defining a pair of convenient handles for the tote bag as illustrated in FIG. 2. Because each strap 44 is preferably configured with a male and female clip member 45, 47, one of the clips 50 is female while the other is male, and similarly, one of the clips 52 is female while the other is male.

Figure 7:
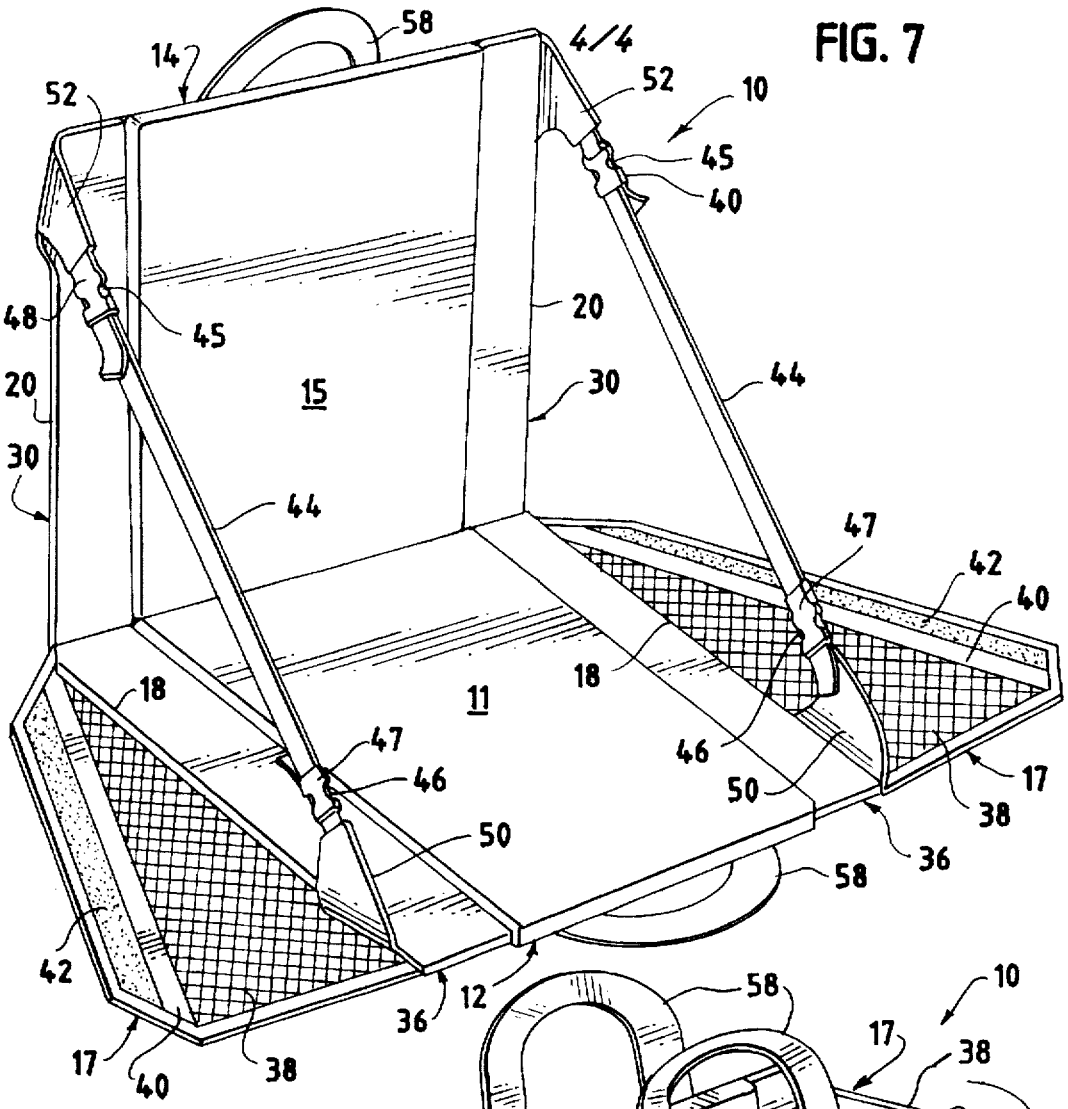
FIG. 7 is a perspective view of an alternative embodiment of the present invention showing the apparatus assembled as a seat.
Figure 8:
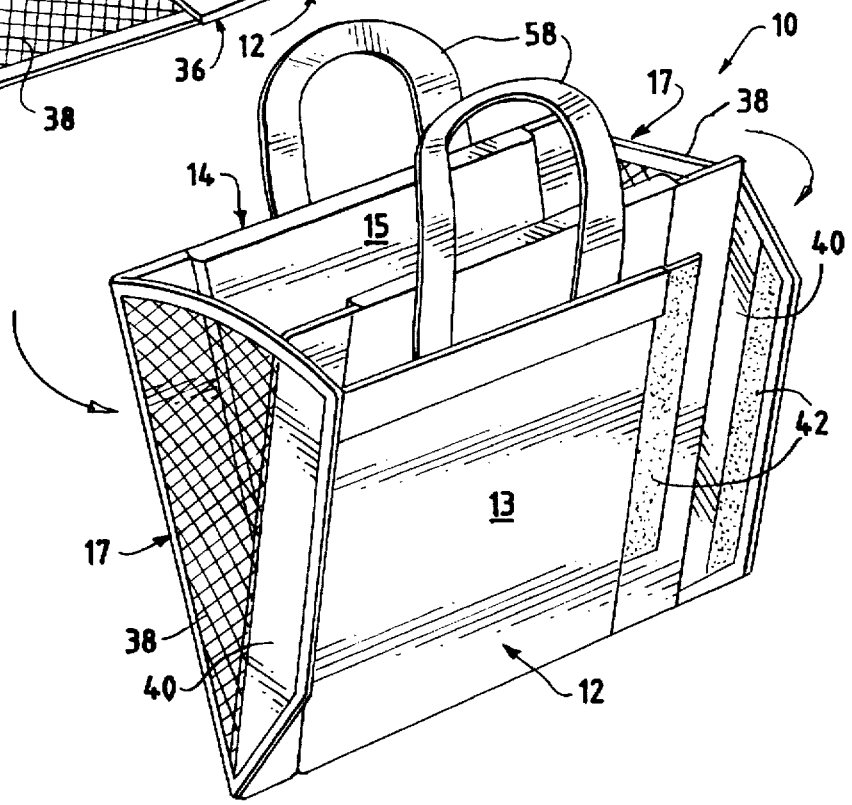
FIG. 8 is a perspective view of the apparatus shown in FIG. 7 assembled as a tote bag.

As will be appreciated by those skilled in the art, numerous modifications can be made to the apparatus 10. For example, in an alternative embodiment of the invention shown in FIGS. 7 and 8, the bottom or intermediate panel 16 is omitted such that the seat panel 12 and back panel 14 are hingedly secured directly to each other. As such, the side flaps 18 are tapered to accommodate the V-shaped spacing between the panels 12, 14 when the apparatus of the present invention is configured as tote bag as shown in FIG. 8. In addition, a pair of handles 56 are fixedly attached to the panels 12 and 14, and the mesh pattern of the side flaps 18 are diagonal.

Thus, an attractive convertible seat/tote bag is provided which is lightweight, portable, and easily converted from a seat to a tote bag with handles.

From the foregoing, it will be observed that numerous modifications and variations can be effected without departing from the true spirit and scope of the novel concept of the present invention. It will be appreciated that the present disclosure is intended as an exemplification of the invention, and is not intended to limit the invention to the specific embodiment illustrated. The disclosure is intended to cover by the appended claims all such modifications as fall within the scope of the claims.

What is claimed is:

1. A convertible seat and tote bag apparatus, comprising:

a first panel;

a second panel, the first panel being foldable relative to the second panel;

a pair of connectors having releasable connectable elements, said connectors projecting from opposite side edges of said first panel and configured to be releasably attached to corresponding side edges of said second panel to allow said apparatus to be assembled in a tote bag configuration; and a support member configured to interconnect the first panel and second panel in a seat-like configuration after the connectors have been detached from said second panel to allow a person to sit on one of said panels with said support member restraining rearward movement of the other of said panels.

2. The apparatus of claim 1 further comprising a central panel interconnecting the first and second panels.

3. The apparatus of claim 2 wherein the connectors comprise flexible extensions projecting outwardly in a direction generally normal to one of said first, second and central panels for releasably attaching said first and second panels to each other when said apparatus is in a bag-like configuration.

4. The apparatus of claim 2 further comprising a pair of lateral flaps extending from opposing side edges of the central panel, said lateral flaps fitting inwardly between the side flaps when said apparatus is configured as a tote bag to fill a space between each side flap and the central panel to thereby inhibit smaller items from inadvertently falling from the tote-bag.

5. The apparatus of claim 1 wherein the connectors comprise a pair of side flaps extending along a lengthwise portion of the respective side edges of the first panel.

6. The apparatus of claim 5 wherein the side flaps are configured with a mesh pattern of flexible material.

7. The apparatus of claim 6 further comprising hook and loop type fasteners provided on the side edges of the side flaps and the corresponding side edges of the second panel for releasably connecting the side flaps to the side edges of the second panel.

8. The apparatus of claim 1 wherein the first and second panels are made of a generally flexible, lightweight material.

9. The apparatus of claim 8 wherein the first and second panels include elongated stiffener members extending along the side edges thereof.

10. The apparatus of claim 1 wherein the support member is convertible into a handle attached to one of the front and rear panels when said apparatus is in a tote bag configuration.

11. The apparatus of claim 1 wherein the first panel defines a seat and the second panel defines a back, and wherein the support member comprises a pair of detachable straps extending diagonally between the first panel and second panel.

12. The apparatus of claim 11 further comprising a pair of back clip members attached to the corners of the first panel, and pair of seat clip members attached to the corners of the second panel, wherein the straps are configured to releasably interconnect the respective back and seat clip members such that the first panel is generally perpendicular to said second panel to define a seat.

13. The apparatus of claim 12 further comprising a first pair of clip members attached to an exterior surface of the first panel, and a second pair of clip members attached to an exterior surface of the second panel, wherein one of said straps is configured to releasably interconnect the first clip members and the other of said straps is configured to releasably interconnect the second clip members to define a pair of handles when the apparatus is in a tote bag configuration.

14. A convertible seat and tote bag apparatus, comprising:

a seat panel hingedly connected to a back panel by a relatively narrow central panel;

a pair of side flaps extending from opposite side edges of one of said seat panel and back panel, said side flaps having releasable connectable elements, said side flaps extending along a substantial lengthwise portion of said side edges and adapted to be releasably attached to corresponding side edges of the other of said seat panel and back panel to define a tote bag; and a pair of detachable straps interconnecting the seat panel and back panel in a seat-like configuration, said straps extending diagonally between the seat panel and the back panel to restrain rearward movement of said back panel.

15. The apparatus of claim 14 further comprising a pair of lateral flaps extending from opposing side edges of the central panel, said lateral flaps fitting inwardly between the side flaps when said apparatus is configured as a tote bag to fill a space between each side flap and the central panel to thereby inhibit smaller items from inadvertently falling from the tote-bag.

16. The apparatus of claim 14 wherein the side flaps are configured with a transparent mesh pattern of flexible material.

17. The apparatus of claim 14 further comprising hook and loop type fasteners provided on the side edges of the side flaps and the corresponding side edges of the back panel for releasably interconnecting the side flaps to the back panel.

18. The apparatus of claim 14 wherein the first and back panels are made of a generally flexible, lightweight material.

19. The apparatus of claim 14 wherein the seat and back panels include elongated stiffener members extending along the side edges thereof.

20. The apparatus of claim 14 further comprising a pair of back clip members attached to the back panel, and pair of seat clip members attached to the seat panel, wherein the straps are configured to releasably interconnect the respective back and seat clip members such that the seat panel is generally perpendicular to said back panel to define a seat.

21. The apparatus of claim 20 further comprising a first pair of clip members attached to an exterior surface of the seat panel, and a second pair of clip members attached to an exterior surface of the back panel, wherein one of said straps is configured to releasably interconnect the first clip members and the other of said straps is configured to releasably interconnect the second clip members to define a pair of handles when the apparatus is in a tote bag configuration.

22. A convertible seat and tote bag apparatus, comprising:

a seat panel hingedly connected to a back panel by a relatively narrow central panel, said seat panel having a pair of seat clip members attached to thereto and said back panel having a pair of back clip members attached thereto;

a pair of side flaps having releasable connectable elements, said side flaps extending from opposite side edges of said seat panel and adapted to be removably attached to corresponding side edges of said back panel to define a tote bag; and a pair of lateral flaps extending from opposing side edges of the central panel, said lateral flaps fitting inwardly between the side flaps when said apparatus is configured as a tote bag to fill a space between each side flap and the central panel to thereby inhibit smaller items from inadvertently falling from the tote-bag;

a pair of detachable straps configured to releasably interconnect the respective back and seat clip members such that the straps extend diagonally between the back panel and the seat panel, thereby restraining rearward movement of said back panel as a person sits on the seat panel and leans against the back panel; and a first pair of clip members attached to an exterior surface of the seat panel and a second pair of clip members attached to an exterior surface of the back panel, wherein one of said straps is configured to releasably interconnect the first clip members and the other of said straps is configured to releasably interconnect the second clip members to define a pair of handles when the apparatus is in a tote bag configuration.

23. A convertible seat and tote bag apparatus, comprising:

a first panel;

a second panel, the first panel being foldable relative to the second panel to define a space therebetween when the apparatus is configured as a tote bag;

a detachable support member interconnecting the first panel and second panel to restrain movement of one of said panels when the apparatus is configured as a seat; and a fastener attached to one of the first and second panels and releasably engaging the support member to define a handle when the apparatus is configured as a tote bag.

24. The apparatus of claim 23 wherein the first panel defines a seat and the second panel defines a back, and wherein the support member comprises a pair of detachable straps extending diagonally from corners of the first panel to respective corners of the second panel.

25. The apparatus of claim 24 further comprising a pair of back clip members attached to the corners of the first panel, and pair of seat clip members attached to the corners of the second panel, wherein the straps are adapted to releasably interconnect the respective back and seat clip members such that the first panel is generally perpendicular to said second panel to define a seat.

26. The apparatus of claim 25 further comprising a first pair of clip members attached to an exterior surface of the first panel, and a second pair of clip members attached to an exterior surface of the second panel, wherein one of said straps is adapted to releasably interconnect the first clip members and the other of said straps is configured to releasably interconnect the second clip members to define a pair of handles when the apparatus is in a tote bag configuration.

27. A convertible seat and tote bag apparatus, comprising:

a first generally rectangular panel flexibly connected to a second generally rectangular panel, each panel having opposed side edges and inner and outer surfaces, with said first panel having extensions projecting from opposite sides thereof for maintaining said first and second panels in parallel relationship relative to each other when said apparatus is in a bag-like configuration, said extensions having releasable connectable elements for connecting the first panel to the second panel; and a plurality of straps configured to interconnect the first and second panels in generally normal relation relative to each other when said apparatus is converted to a seat-like configuration and after said extensions have been detached from first and second panels.

28. The apparatus of claim 27 wherein said flexible extensions comprise elongated flaps hingedly secured to and along opposite sides of said first panel.

29. The apparatus of claim 28 wherein said elongated flaps have a diverging angular configuration.

30. The apparatus of claim 27 wherein each panel has inner and outer surfaces, and wherein the free ends of the extensions are releasably attached to an outer surface of said second panel.

* * * * *